US005351766A

United States Patent [19]

Wenzel et al.

[11] Patent Number: 5,351,766

[45] Date of Patent: Oct. 4, 1994

[54] FLOW RESTRICTER FOR MUD LUBRICATED EARTH DRILLING MOTORS

[75] Inventors: Kenneth H. Wenzel; Dean Foote, both of Edmonton, Canada

[73] Assignee: Vector Oil Tool Ltd., Canada

[21] Appl. No.: 976,887

[22] Filed: Nov. 16, 1992

[30] Foreign Application Priority Data

Nov. 22, 1991 [CA] Canada ..... 2056043

[51] Int. Cl.[5] ..... E21B 4/02

[52] U.S. Cl. ..... 175/107

[58] Field of Search ..... 175/107, 92, 320, 324, 175/337; 418/48, 102

[56] References Cited

U.S. PATENT DOCUMENTS

| | | | |
|---|---|---|---|
| 3,936,247 | 1/1976 | Tschirky et al. | 418/48 |
| 3,982,859 | 9/1976 | Tschirky et al. | 418/48 |
| 4,546,836 | 10/1985 | Dennis et al. | 175/107 |
| 4,577,704 | 3/1986 | Aumann | 175/107 |
| 4,819,745 | 4/1989 | Walter | 175/107 |
| 5,096,004 | 3/1992 | Ide | 175/107 |
| 5,174,392 | 12/1992 | Reinhardt | 175/107 |

*Primary Examiner*—Thuy M. Bui
*Attorney, Agent, or Firm*—Davis, Bujold & Streck

[57] ABSTRACT

A flow restrictor for a mud lubricated earth drilling motor consisting of a first seal support non-rotatably coupled to an outer housing and a second seal support non-rotatably coupled to an inner tubular member which is telescopically received within the outer housing. The first seal support having a first seal face and the second seal support having a second seal face. The first seal support and the second seal support are axially movable. A plurality of springs engage the first seal support to exert a biasing force bringing the first seal face into sealing engagement with the second seal face to form a mechanical seal, having a first side adjacent the outer housing and a second side adjacent the inner tubular member. A first fluid flow passage extends from the interior drilling mud flow passage of the inner tubular member the first side of the mechanical seal. A second fluid flow passage extends from the second side of the mechanical seal to exterior of the outer housing. At least one groove is provided across the first seal face and the second seal face, extending from the first side to the second side of the mechanical seal, such that a continuous flow of drilling mud passes through the groove and is vented to the exterior of the outer housing via the second fluid flow passage.

8 Claims, 2 Drawing Sheets

FLOW RESTRICTER FOR MUD LUBRICATED EARTH DRILLING MOTORS

The present invention relates to a flow restricter for lubricated earth drilling motors.

BACKGROUND OF THE INVENTION

A number of downhole motors used in the oil or mining industries for drilling through earth formations are mud lubricated. These earth drilling motors have an outer housing, an inner tubular member concentrically disposed within the outer housing, and a plurality of bearings disposed between the outer housing and the inner tubular member to facilitate the rotation of the inner tubular member. Mud lubrication is passed through a passage in the tool firstly, to provide some lubrication for the bearings and secondly, to dissipate heat which builds up within the tool.

Each mud lubricated tool requires a flow restricter to control the rate of mud flow. This is particularly critical at pressures in excess of 500 pounds per square inch. If the flow is too great it will "wash away" portions of the tool until the tool is destroyed. Conversely, if the flow is substantially cut off the heat will not be effectively dissipated and the tool will be destroyed by the resulting heat build up.

Mechanical seals have previously been used for the flow restricter, due to their ability to function at the pressure levels required. Mechanical seals work effectively when the tool is newly constructed, however, as wear occurs in the tool these flow restricters lose their effectiveness. It is common knowledge in the art that a critical factor in having effective sealing with mechanical seals is controlling the pressure on the seal faces. When wear occurs in bearings axial movement occurs which effects the pressure on the seal faces.

SUMMARY OF THE INVENTION

What is required is a flow restricter using mechanical seals which is self-adjusting to maintain its effectiveness in the face of tool wear.

According to the present invention there is provided a Flow Restricter for a mud lubricated earth drilling motor, having an outer housing, an inner tubular member with an interior drilling mud flow passage concentrically disposed within the outer housing, and a plurality of bearings disposed between the outer housing and the inner tubular member facilitating the rotation of the inner tubular member. The Flow Restricter is comprised of a first seal support having a first seal face and a second seal support having a second seal face. Means is provided for non-rotatably coupling the first seal support within an interior bore of an outer housing while permitting the first seal support to be axially movable in relation to the outer housing. Means is provided for non-rotatably coupling the second seal face to an exterior surface of an inner tubular member while permitting the second seal support to be axially movable in relation to the inner tubular member. The second seal face is in axial alignment with the first seal face. Biasing means exert a biasing force axially upon the first seal support thereby bringing the first seal face into sealing engagement with the second seal face to form a mechanical seal, having a first side adjacent the outer housing and a second side adjacent the inner tubular member. Stop means limit the movement of the second seal support. A first fluid flow passage extends from the interior drilling mud flow passage of the inner tubular member to one of the first side and the second side of the mechanical seal. A second fluid flow passage extends from the other of the first side and the second side of the mechanical seal to exterior of the outer housing. At least one groove is provided in one of the first seal face and the second seal face, extending from the first side to the second side of the mechanical seal, such that a continuous flow of drilling mud passes through the groove and is vented to the exterior of the outer housing via the second fluid flow passage.

The invention provides for grooves in the seal faces which turns the mechanical seal into a Flow Restricter. Incorporated within the design is allowance for axial movement which enables the mechanical seal to self-adjust in order to maintain its effectiveness in the face of tool wear. The biasing means permits axial adjustment of the positioning of the first seal support and second seal support as wear occurs.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
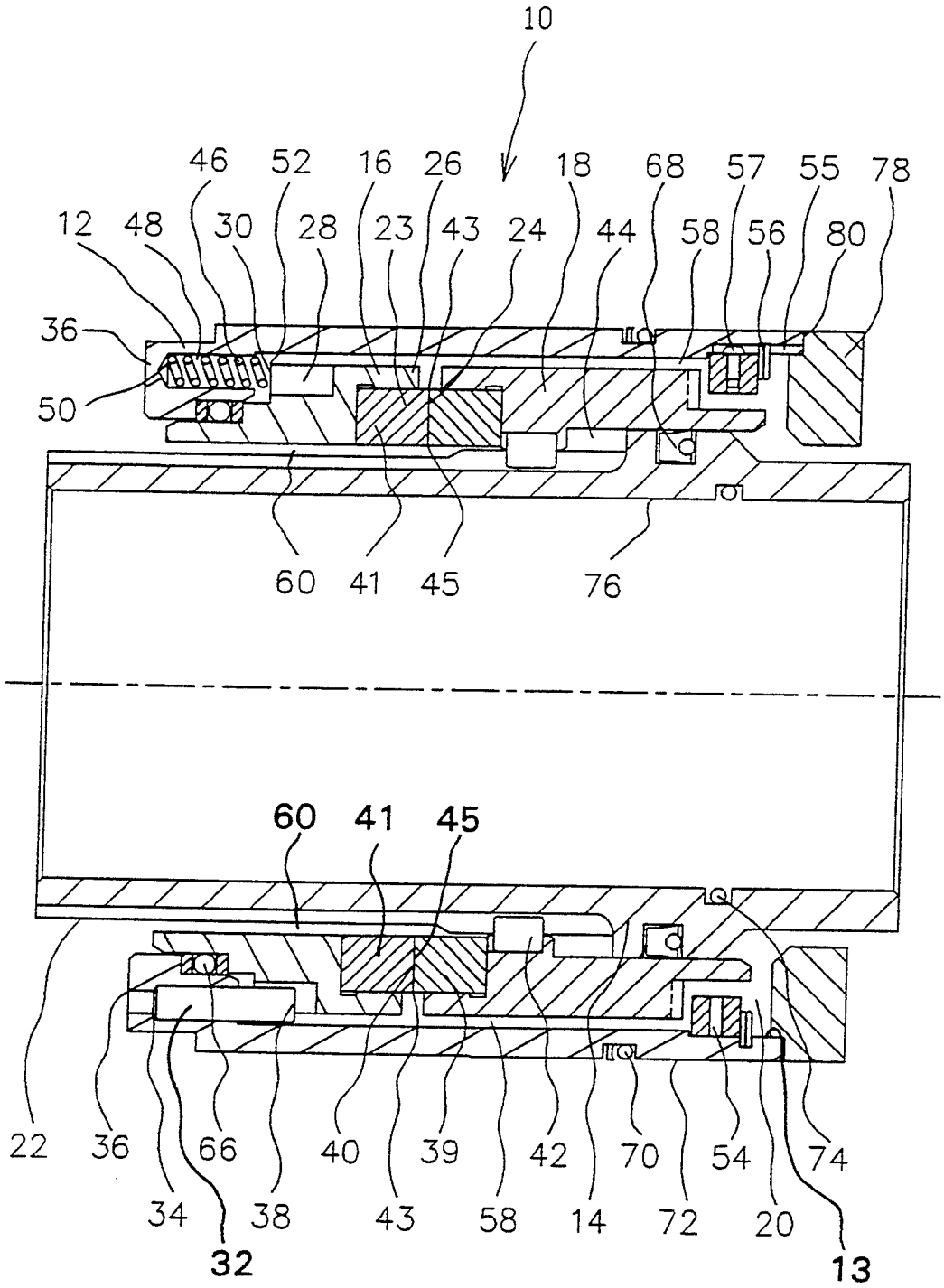
FIG. 1 is a longitudinal section view of a Flow Restricter cartridge constructed in accordance with the teachings of the present invention.

The preferred embodiment, a Flow Restricter generally identified by reference numeral 10, will now be described with reference to FIGS. 1 and 2.

Flow Restricter 10 was first developed as an integral part of a bearing assembly for an earth drilling motor. At the request of customers who were experiencing similar "washing" problems, but had their own bearing assembly design, Flow Restricter 10 was placed into a "cartridge" format. The cartridge form of Flow Restricter 10 is illustrated in FIG. 1. In the cartridge form Flow Restricter 10 is inserted into bearing assemblies constructed by several manufacturers.

Figure 2:
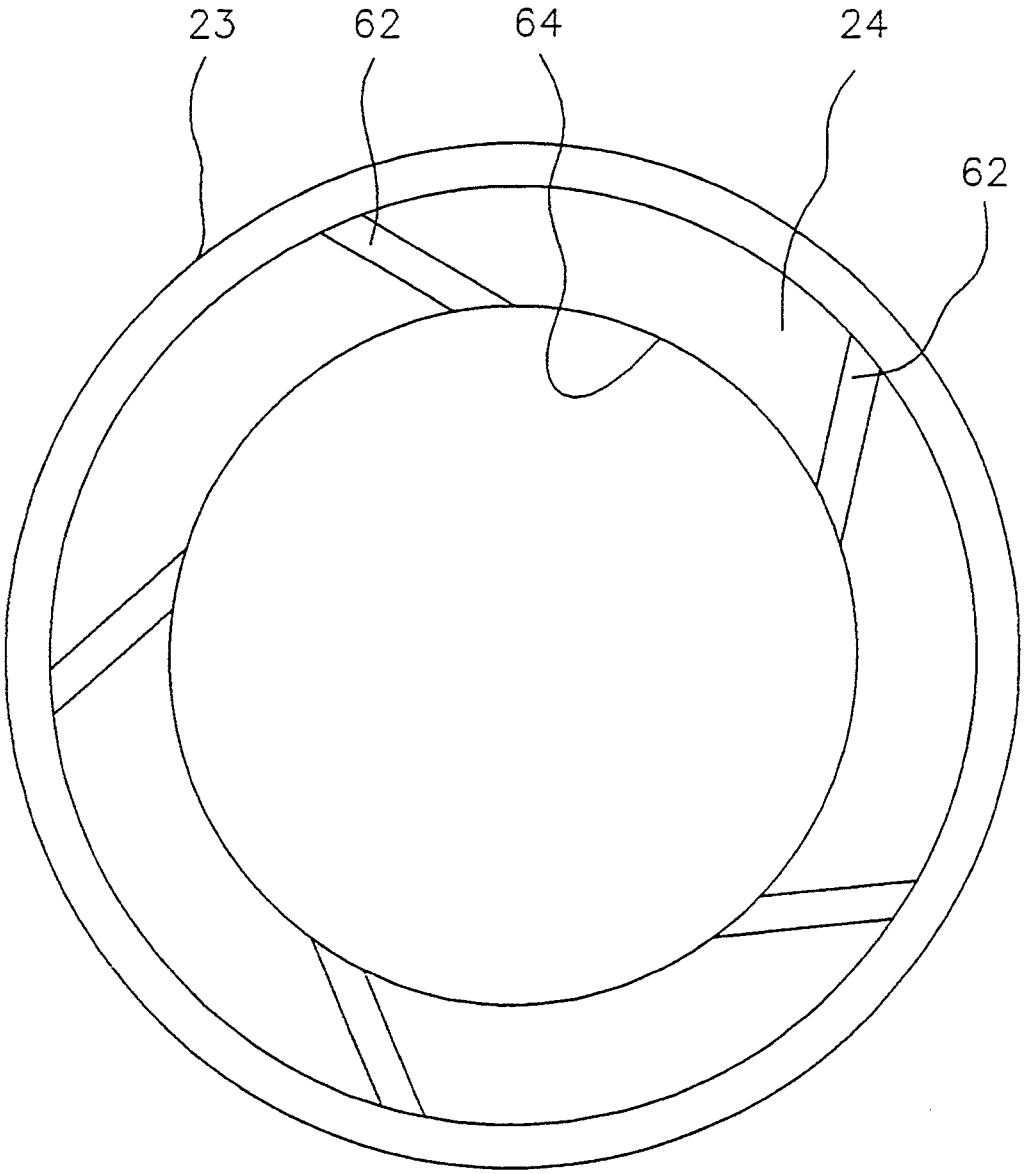
FIG. 2 is a detailed view of a seal face from the Flow Restricter cartridge illustrated in FIG. 1.

Referring to FIG. 1, the primary components of Flow Restricter cartridge 10 are a cartridge housing 12, an inner cartridge member 14, a first seal support 16, and a second seal support 18. Cartridge housing 12 and inner cartridge member 14 are of cylindrical tubular construction. Cartridge housing 12 inner surface 13 defining an has an interior bore 20. Inner cartridge member 14 has an exterior surface 22.

First seal support 16 has a first annular seal ring 23 with a first seal face 24 at one end 26 and a plurality of axially extending passages 28 at an opposed end 30. A plurality of pins 32 are provided each of which has one end 34 secured to an annular shoulder 36 within interior bore 20 of cartridge housing 12 and an opposed end 38 which extends axially. Each opposed end 38 of pins 32 is telescopically received within axial passage 28 first seal support 16. In this manner first seal support 16 is non-rotatably coupled to cartridge housing 12 and yet remains axially movable in relation to cartridge housing 12 on pins 32. Second seal support 18 has a second annular seal ring 39 with a second seal face 40. Second seal support 18 has a plurality of axially extending key 42 which matingly engage axially extending keyways 44 on exterior surface 22 of inner cartridge member 14. In this manner second seal support 18 is non-rotatably coupled to exterior surface 22 of inner cartridge member 14 and yet remains axially movable in relation to inner cartridge member 14 on axially extending keyways 44. Second seal face 40 is at all times in axial alignment with first seal face 24. A plurality of coil springs 46 are disposed in pockets 48 in annular shoulder 36 in interior bore 20 of cartridge housing 12 serve as biasing means. Each of coil springs 46 have a first end 50 which engages annular shoulder 36 and a second end 52 which engages end 30 of first seal support 16. Coil springs 46 exert a biasing force axially upon first seal support 16 to bring first seal face 24 into sealing engagement with second seal face 40 to form a mechanical seal, generally identified by reference numeral 41. Mechanical seal 41 has a first side 43 adjacent cartridge housing 12 and a second side 45 adjacent inner cartridge member 14. A retainer ring 54 serves as a stop means for limiting the movement of second seal support 18. Retainer ring 54 is held in place by snap ring 56. A groove 55 is provided along interior bore 20 of cartridge housing 12. A screw 57 extends through retainer ring 54 into groove 55 to prevent rotation of retainer ring 54. A first fluid flow passage 58 extends through cartridge housing 12 to first side 43 of mechanical seal 41. A second fluid flow passage 60 extends from second side 45 of mechanical seal 41 along exterior surface 22 of inner cartridge member 14 to exterior of Flow Restricter cartridge 10. Referring to FIG. 2, a plurality of grooves 62 in seal faces 24 and 40 extend through mechanical seal 41 from first side 43 to second side 45. Grooves 62 are angled across seal faces 24 and 40 such that the flow of drilling mud through groove 62 is directed against an inner circumference 64 of one of annular seal rings 23 and 39. In order to prevent drilling mud from bypassing first fluid flow passage 58, elastomer seals 66 and 68 are provided. Seal 66 prevents drilling mud from passing between cartridge housing 12 and first seal support 16. Seal 68 prevents drilling mud from passing between cartridge inner member 14 and second seal support 18. A seal 70 is provided on exterior surface 72 of cartridge housing 12. A seal 74 is provided along interior bore 76 of inner cartridge member 14. An annular member 78 is provided at one end 80 of outer cartridge 12. The purpose of seal 70 seal 74, and annular member 78 will be hereinafter further explained with respect to the use and operation of the invention.

The use and operation of Flow Restricter Cartridge 10 will now be described with respect to FIGS. 1 and 2. Flow Restricter cartridge 10 must be installed as a component of a bearing assembly for a drilling motor before it can function. When the drilling motor is operating, drilling mud passes through first fluid flow passage 58 of Flow Restrictor cartridge 10. As the drilling mud passes through first fluid flow passage 58 it exerts a force upon second seal support 18 which causes springs 46 to be partially compressed. When the flow of drilling mud reaches first side 43 of mechanical seal 41, the drilling mud bleeds through grooves 62 angled across seal faces 24 and 40. This would normally cause a washing action, however, the flow is directed against inner circumference 64 of annular seal rings 23 and 39. This causes the flow to spiral, thereby losing some of its potentially damaging force. The force would create a washing action in softer metals, however, annular seal rings 23 and 39 are made of silicon carbide, tungsten carbide, or a similar hard material so as to be able to withstand the force of the fluid flow. The pressure with which first seal face 24 and second seal face 40 engage is determined by the force exerted upon coil springs 46. Coil springs 46 are therefore selected based upon the flow rate deemed suitable. In the past, as the bearings in a drilling motor having mechanical seals began to wear, axial movement occurred as between the outer housing and the inner tubular member and a gap was created between the first seal face and the second seal face resulting in an eventual "washing" out of the tool. With Flow Restricter cartridge 10 allowance is made for axial movement by first seal support 16 and second seal support 18. Axial movement which occurs within drilling motor 100 as a result of wear is accommodated with the range of movement of first seal support 16 and second seal support 18. As first seal face 16 and second seal support 18 move axially, coil springs 46 maintain first seal face 24 and second seal face 40 in engagement at a constant pressure. A continuous flow of drilling mud passed from first side 43 to second side 45 of mechanical seal 41 through grooves 62, and is vented to exterior of flow restrictor cartridge 10 via second fluid flow passage 60.

It will be apparent to one skilled in the art that Flow Restricter 10 addresses the problem of self-adjustment in the face of tool wear present in the art. It will also be apparent to one skilled in the art that modifications may be made to the preferred invention without departing from the spirit and scope of the invention as defined by the claims.

The embodiments of the invention in which an exclusive property or privilege is claimed are defined as follows:

1. A flow restricter using mechanical seals for a mud lubricated earth drilling motor, having an outer housing, an inner tubular member with an interior drilling mud flow passage concentrically disposed within the outer housing, and a plurality of bearings disposed between the outer housing and the inner tubular member facilitating the rotation of the inner tubular member, comprising:

a. a first seal support having a first seal face;

b. means secured to an inner surface of the outer housing for non-rotatably coupling the first seal support within an interior bore of the outer housing while permitting the first seal support to be axially movable in relation to the outer housing;

c. a second seal support having a second seal face;

d. means secured to an exterior surface of the inner tubular member for non-rotatably coupling the second seal face to the exterior surface of the inner tubular member while permitting the second seal support to be axially movable in relation to the inner tubular member, the second seal face being in axial alignment with the first seal face;

e. biasing means secured to one of the inner surface of the outer housing and the exterior surface of the inner tubular member for exerting a biasing force axially upon the first seal support thereby bringing the first seal face into sealing engagement with the second seal face to form a mechanical seal having a first side adjacent the outer housing and a second side adjacent the inner tubular member;

f. stop means secured to one of the exterior surface of the inner tubular member and the inner surface of the outer housing for limiting the movement of the second seal support;

g. a first fluid flow passage which extends from the interior drilling mud flow passage of the inner tubular member to one of the first side and the second side of the mechanical seal;

h. a second fluid flow passage which extends from the other of the first side and the second side of the mechanical seal to exterior of the outer housing; and i. at least one groove in one of the first seal face and the second seal face and extending from the first side to the second side of the mechanical seal such that a continuous flow of drilling mud passes through the groove and is vented to the exterior of the outer housing via the second fluid flow passage.

2. The flow restricter as defined in claim 1, the first seal face and the second seal face being positioned on annular seal rings, and the at least one groove being angled across the seal faces such that the flow of drilling mud through the groove is directed against an inner circumference of one of the annular rings.

3. The flow restricter as defined in claim 1, the means for non-rotatably coupling the first seal support to the outer housing being a plurality of pins having one end secured to the inner surface of the outer housing and an opposed end extending axially each of which is telescopically received within an axial passage in the first seal support.

4. The flow restricter as defined in claim 1, the biasing means being a plurality of coil springs, each of the coil springs having a first end which engages a shoulder projecting from the inner surface within the interior bore of the outer housing and a second end which engages the first seal support.

5. The flow restricter as defined in claim 1, the means for non-rotatably coupling the second seal support being axial keys on one of the exterior surface of the inner tubular member and second seal support which matingly engage axial keyways on the other of the inner tubular member and second seal support.

6. The flow restricter as defined in claim 1, being in the form of a cartridge having a cartridge housing which is adapted for connection to the outer housing of an earth drilling motor, and a inner cartridge member which is adapted for connection to the inner tubular member of an earth drilling motor.

7. A flow restricter using mechanical seals for a mud lubricated earth drilling motor, having an outer housing, an inner tubular member with an interior drilling mud flow passage concentrically disposed within the outer housing, and a plurality of bearings disposed between the outer housing and the inner tubular member facilitating the rotation of the inner tubular member, comprising:

a. a first seal support having a first seal face an one end and a plurality of axially extending passages at an opposed end;

b. a plurality of pins having one end secured to an inner surface within an interior bore of an outer housing and an opposed end extending axially, each of the opposed ends of the pins being telescopically received within the axial passage in the first seal support, such that the first seal support is non-rotatably coupled to the outer housing and axially movable in relation to the outer housing;

c. a second seal support having a second seal face, the second seal face having a plurality of axial keys which matingly engage axial keyways on an exterior surface of an inner tubular member such that the second seal support is non-rotatably coupled to the exterior surface of the inner tubular member and axially movable in relation to the inner tubular member, the second seal face being in axial alignment with the first seal face;

d. a plurality of coil springs disposed in pockets in an annular shoulder projecting from the inner surface in the interior bore of the outer housing, each of the coil springs having a first end which engages the annular shoulder and a second end which engages the first seal support thereby exerting a biasing force axially upon the first seal support to bring the first seal face into sealing engagement with the second seal face to form a mechanical seal, having a first side adjacent the outer housing and a second side adjacent the inner tubular member;

e. stop means secured to one of the exterior surface of the inner tubular member and the inner surface of the outer housing for limiting the movement of the second seal support; and f. a first fluid flow passage which extends from the interior mud passage of the inner tubular member to one of the first side and the second side of the mechanical seal;

g. a second fluid flow passage which extends from the other of the first side and the second side of the mechanical seal to exterior of the outer housing; and h. at least one groove in one of the first seal face and the second seal face and extending from the first side to the second side of the mechanical seal such that a continuous flow of drilling mud passes through the groove and is vented to the exterior of the outer housing via the second fluid flow passage, the first seal face and the second seal face being positioned on annular seal rings, and the at least one groove angled across the seal faces such that the flow of drilling mud through the groove is directed against an inner circumference of one of the annular rings.

8. A flow restricter using mechanical seals for a mud lubricated earth drilling motor, having an outer housing, an inner tubular member with an interior drilling mud flow passage concentrically disposed within the outer housing, and a plurality of bearings disposed between the outer housing and the inner tubular member facilitating the rotation of the inner tubular member, comprising:

a cartridge consisting of:

a. a cartridge housing which is adapted for connection to an outer housing of an earth drilling motor;

b. an inner cartridge member which is adapted for connection to the inner tubular member of an earth drilling motor;

c. a first seal support having a first annular sealing ring with a first seal face at one end and a plurality of axially extending passages at an opposed end;

d. a plurality of pins having one end secured to an inner surface within an interior bore of the cartridge housing and an opposed end extending axially, each of the opposed ends of the pins being telescopically received within the axial passage in the first seal support, such that the first seal support is non-rotatably coupled to the cartridge housing and axially movable in relation to the cartridge housing;

e. a second seal support having a second annular sealing ring and a second seal face, the second seal support having a plurality of axially extending keyways which matingly engage axially extending keys on an exterior surface of the inner cartridge member such that the second seal support is non-rotatably coupled to the exterior surface of the inner cartridge member and axially movable in relation to the inner cartridge member, the second seal face being in axial alignment with the first seal face;

f. a plurality of coil springs disposed in pockets in an annular shoulder projecting from the inner surface in the interior bore of the cartridge housing, each of the coil springs having a first end which engages the annular shoulder and a second end which engages the first seal support thereby exerting a biasing force axially upon the first seal support to bring the first seal face into sealing engagement with the second seal face to form a mechanical seal, having a first side adjacent the cartridge housing and a second side adjacent the inner cartridge member;

g. stop means projecting from the exterior surface of the inner cartridge member for limiting the movement of the second seal support; and h. a first fluid flow passage which is adapted for connection between the interior mud passage of the inner tubular member to one of the first side and the second side of the mechanical seal;

i. a second fluid flow passage which is adapted to for connection from the other of the first side and the second side of the mechanical seal to exterior of the outer housing; and j. at least one groove in one of the first seal face and the second seal face and extending from the first side to the second side of the mechanical seal such that a continuous flow of drilling mud passes through the groove and is vented to the exterior of the outer housing via the second fluid flow passage, the at least one groove being angled across the seal faces such that the flow of drilling mud through the groove is directed against an inner circumference of one of the annular rings.

* * * * *